US008490792B2

(12) United States Patent
D'Amato

(10) Patent No.: US 8,490,792 B2
(45) **Date of Patent: *Jul. 23, 2013**

(54) PACKAGE

(75) Inventor: Gianfranco D'Amato, Arzano Napoli (IT)

(73) Assignee: Seda S.p.A., Arzano Napoli (IT)

( * ) Notice: Subject to any disclaimer, the term of this patent is extended or adjusted under 35 U.S.C. 154(b) by 26 days.

This patent is subject to a terminal disclaimer.

(21) Appl. No.: 11/998,619

(22) Filed: Nov. 30, 2007

(65) Prior Publication Data

US 2008/0164268 A1 Jul. 10, 2008

(30) Foreign Application Priority Data

Dec. 5, 2006 (DE) ..... 20 2006 018 406 U

(51) Int. Cl.
*B65D 3/22* (2006.01)

(52) U.S. Cl.
USPC ..... 206/459.5; 206/831; 229/403; 229/400

(58) Field of Classification Search
USPC ..... 206/831, 459.5, 459.1, 217; 220/592.2, 220/660, 737–739; 229/403, 400, 402; 283/105, 283/100, 103; 40/306, 310, 312
See application file for complete search history.

(56) References Cited

U.S. PATENT DOCUMENTS

| | | | |
|---|---|---|---|
| 23,200 | A | 3/1859 | Stimpson |
| 1,031,514 | A | 7/1912 | Bjorkstam et al. |
| 1,520,870 | A | 12/1924 | Koch |
| 1,549,417 | A | 8/1925 | Hendrich |
| 1,615,319 | A | 1/1927 | Wynn |
| 1,654,318 | A | 12/1927 | Benson |
| 1,685,494 | A | 9/1928 | Koch |
| 1,706,910 | A | 3/1929 | Wright et al. |
| 1,756,243 | A | 4/1930 | Benson |
| 1,759,407 | A | 5/1930 | Kingsbury |
| 1,814,671 | A | 7/1931 | Dufour |
| 2,053,726 | A | 9/1936 | Marshall |
| 2,134,427 | A | 10/1938 | Biderman |
| 2,156,328 | A | 5/1939 | Barbieri |
| 2,157,054 | A | 5/1939 | Gammeter |

(Continued)

FOREIGN PATENT DOCUMENTS

| | | |
|---|---|---|
| AR | 047625 | 2/2006 |
| AT | 141212 T | 8/1996 |

(Continued)

OTHER PUBLICATIONS

Statement of Case in Opposition to New Zealand Patent Application No. 543602, Mar. 22, 2007, 79 pages.

(Continued)

*Primary Examiner* — Steven A. Reynolds
(74) *Attorney, Agent, or Firm* — Fish & Richardson P.C.

(57) ABSTRACT

A package includes a container having an opening, a bottom and at least one inner wall. The package further includes at least one outer wall formed from a two-dimensional pre-cut part having a removable wall section that is a removable card which discloses an information. The pre-cut part includes an access section that is formed at a peripheral edge of the pre-cut part so as to provide an open space adjacent to the removable wall section when the pre-cut part is connected to itself to form the outer wall of the package.

11 Claims, 12 Drawing Sheets

U.S. PATENT DOCUMENTS

| | | | | |
|---|---|---|---|---|
| 2,288,602 | A | | 5/1939 | Benton |
| 2,170,060 | A | | 8/1939 | Meyer |
| 2,216,331 | A | | 10/1940 | Swallow et al. |
| 2,226,340 | A | | 12/1940 | Flood |
| 2,235,963 | A | | 3/1941 | McGirr et al. |
| 2,240,599 | A | | 5/1941 | Amberg |
| 2,266,828 | A | | 12/1941 | Sykes |
| 2,416,813 | A | | 3/1947 | Barbieri |
| 2,462,497 | A | | 2/1949 | Heyman |
| 2,493,633 | A | | 1/1950 | Mart |
| 2,540,565 | A | | 2/1951 | Barbieri |
| 2,563,352 | A | | 8/1951 | Morse |
| 2,591,578 | A | | 4/1952 | McNealy et al. |
| 2,661,889 | A | | 12/1953 | Phinney |
| 2,666,542 | A | | 1/1954 | Price |
| 2,675,954 | A | | 4/1954 | Vogel |
| 2,689,424 | A | | 9/1954 | Clagett |
| 2,692,722 | A | | 10/1954 | Johnson |
| 2,695,744 | A | | 11/1954 | Gattuso |
| 2,721,686 | A | | 10/1955 | Reifsnyder et al. |
| 2,725,733 | A | | 12/1955 | Howlett |
| 2,740,575 | A | | 4/1956 | Fontaine |
| 2,828,903 | A | | 4/1958 | Adkins |
| 2,863,585 | A | | 12/1958 | Meshberg |
| 2,888,861 | A | | 6/1959 | Meyer-Jagenberg |
| 2,899,098 | A | | 8/1959 | Gits |
| 2,982,465 | A | | 5/1961 | Fallert |
| 3,065,875 | A | | 11/1962 | Negoro |
| 3,079,027 | A | | 2/1963 | Edwards |
| 3,082,900 | A | | 3/1963 | Goodman |
| 3,109,252 | A | | 11/1963 | Schellenberg |
| 3,118,351 | A | | 1/1964 | Meyer-Jagenberg |
| 3,139,213 | A | | 6/1964 | Edwards |
| RE25,618 | E | | 7/1964 | Goodman |
| 3,208,631 | A | | 9/1965 | Edwards |
| 3,225,954 | A | | 12/1965 | Herrick et al. |
| 3,232,512 | A | | 2/1966 | Wanderer |
| 3,298,893 | A | | 1/1967 | Allen |
| 3,355,046 | A | | 11/1967 | Jolly |
| 3,357,053 | A | | 12/1967 | Lyon et al. |
| 3,372,830 | A | | 3/1968 | Edwards |
| 3,401,862 | A | | 9/1968 | Wanderer |
| 3,428,214 | A | | 2/1969 | Leon |
| 3,443,714 | A | | 5/1969 | Edwards |
| 3,456,860 | A | | 7/1969 | Janninck |
| 3,471,075 | A | | 10/1969 | Wolf |
| 3,485,412 | A | | 12/1969 | Hawley |
| 3,526,316 | A | | 9/1970 | Kalogris |
| 3,531,015 | A | | 9/1970 | Makin |
| 3,580,468 | A | | 5/1971 | McDevitt |
| 3,583,596 | A | | 6/1971 | Brewer |
| 3,612,346 | A | | 10/1971 | Schneider et al. |
| 3,645,758 | A | | 2/1972 | MacManus |
| 3,700,018 | A | | 10/1972 | Goglio |
| 3,737,093 | A | * | 6/1973 | Amberg et al. ..... 206/447 |
| 3,739,975 | A | * | 6/1973 | Davidow ..... 229/116.3 |
| 3,747,830 | A | | 7/1973 | Goldman |
| 3,749,277 | A | | 7/1973 | Kinney |
| 3,765,559 | A | | 10/1973 | Sauey et al. |
| 3,766,975 | A | | 10/1973 | Todd |
| D231,068 | S | | 4/1974 | Douglas |
| 3,827,620 | A | | 8/1974 | Ludder |
| 3,836,207 | A | | 9/1974 | Belart |
| 3,846,207 | A | | 11/1974 | MacDaniel et al. |
| 3,850,361 | A | | 11/1974 | Day et al. |
| 3,878,282 | A | | 4/1975 | Bonis et al. |
| 3,884,350 | A | | 5/1975 | Johansson |
| 3,908,523 | A | | 9/1975 | Shikaya |
| 3,926,361 | A | | 12/1975 | Hilderbrand |
| 3,927,766 | A | | 12/1975 | Day |
| 3,934,749 | A | | 1/1976 | Andrulionis |
| 3,955,697 | A | | 5/1976 | Valyi |
| 3,980,107 | A | | 9/1976 | Barnes et al. |
| 4,007,670 | A | | 2/1977 | Albano et al. |
| 4,018,904 | A | | 4/1977 | Muraoka |
| 4,040,537 | A | | 8/1977 | Edwards |
| 4,049,122 | A | | 9/1977 | Maxwell |
| 4,070,953 | A | | 1/1978 | Richards et al. |
| 4,089,358 | A | | 5/1978 | Korson |
| 4,102,454 | A | | 7/1978 | Karevaara et al. |
| 4,124,120 | A | | 11/1978 | Day |
| 4,129,065 | A | | 12/1978 | Corse et al. |
| 4,171,085 | A | | 10/1979 | Doty |
| 4,187,768 | A | | 2/1980 | Suzuki |
| 4,211,024 | A | | 7/1980 | Nickell |
| 4,231,476 | A | | 11/1980 | Compton et al. |
| 4,261,501 | A | | 4/1981 | Watkins et al. |
| 4,292,194 | A | | 9/1981 | Perazzoni et al. |
| 4,308,679 | A | | 1/1982 | Ray, III et al. |
| 4,318,235 | A | | 3/1982 | Augeri |
| 4,324,338 | A | | 4/1982 | Beall |
| 4,327,136 | A | | 4/1982 | Thompson et al. |
| 4,344,814 | A | | 8/1982 | McLaren |
| 4,345,393 | A | * | 8/1982 | Price et al. ..... 40/312 |
| 4,368,818 | A | | 1/1983 | Day et al. |
| 4,409,045 | A | | 10/1983 | Busse |
| 4,409,122 | A | | 10/1983 | Kleuskens et al. |
| 4,514,242 | A | | 4/1985 | MacLaughlin et al. |
| 4,548,348 | A | | 10/1985 | Clements |
| 4,551,365 | A | | 11/1985 | Bonis |
| 4,560,075 | A | | 12/1985 | Lu |
| 4,571,233 | A | | 2/1986 | Konzal |
| 4,574,987 | A | | 3/1986 | Halligan et al. |
| 4,581,003 | A | | 4/1986 | Ito et al. |
| 4,684,553 | A | | 8/1987 | Sasaki et al. |
| 4,706,873 | A | * | 11/1987 | Schulz ..... 229/400 |
| 4,771,911 | A | | 9/1988 | Morony et al. |
| 4,775,523 | A | | 10/1988 | Sparacio et al. |
| 4,789,073 | A | | 12/1988 | Fine |
| 4,792,042 | A | | 12/1988 | Koehn et al. |
| 4,813,862 | A | | 3/1989 | Bowers et al. |
| 4,838,424 | A | | 6/1989 | Petzelt |
| 4,850,496 | A | | 7/1989 | Rudell et al. |
| 4,863,014 | A | | 9/1989 | Summons et al. |
| 4,936,448 | A | | 6/1990 | Holloway |
| 4,955,503 | A | | 9/1990 | Propes |
| 4,993,580 | A | | 2/1991 | Smith |
| 4,997,691 | A | | 3/1991 | Parkinson |
| 5,007,578 | A | * | 4/1991 | Simone ..... 229/400 |
| 5,021,274 | A | | 6/1991 | Beck et al. |
| 5,025,981 | A | | 6/1991 | Schellenberg |
| 5,062,568 | A | | 11/1991 | Hill et al. |
| 5,076,463 | A | | 12/1991 | McGraw |
| 5,078,313 | A | | 1/1992 | Matheson et al. |
| 5,092,485 | A | | 3/1992 | Lee |
| 5,135,132 | A | | 8/1992 | Potochnik |
| 5,145,107 | A | * | 9/1992 | Silver et al. ..... 229/403 |
| 5,226,585 | A | | 7/1993 | Varano |
| 5,253,781 | A | | 10/1993 | Van Melle et al. |
| 5,363,982 | A | | 11/1994 | Sadlier |
| 5,385,260 | A | | 1/1995 | Gatcomb |
| 5,395,005 | A | | 3/1995 | Yoshida |
| 5,425,497 | A | | 6/1995 | Sorensen |
| 5,425,498 | A | | 6/1995 | Hallam et al. |
| 5,460,323 | A | | 10/1995 | Titus |
| 5,484,167 | A | * | 1/1996 | Donaldson et al. ..... 283/67 |
| 5,489,063 | A | | 2/1996 | Buchalski et al. |
| 5,524,817 | A | * | 6/1996 | Meier et al. ..... 229/403 |
| 5,542,599 | A | | 8/1996 | Sobol |
| 5,547,124 | A | | 8/1996 | Mueller |
| 5,551,592 | A | | 9/1996 | Barton et al. |
| 5,553,735 | A | | 9/1996 | Kimura |
| 5,573,141 | A | | 11/1996 | Chen |
| 5,586,689 | A | | 12/1996 | D'Amato et al. |
| 5,593,053 | A | | 1/1997 | Kaufman et al. |
| 5,603,450 | A | | 2/1997 | Whitnell |
| 5,628,453 | A | | 5/1997 | MacLaughlin |
| 5,660,326 | A | | 8/1997 | Varano et al. |
| 5,660,898 | A | | 8/1997 | Calvert |
| 5,671,353 | A | | 9/1997 | Tian et al. |
| 5,674,546 | A | | 10/1997 | Barnes et al. |
| 5,678,725 | A | | 10/1997 | Yamada et al. |
| 5,685,480 | A | | 11/1997 | Choi |
| 5,697,550 | A | | 12/1997 | Varano et al. |
| 5,713,512 | A | | 2/1998 | Barrett |
| 5,752,653 | A | * | 5/1998 | Razzaghi ..... 229/403 |
| RE35,830 | E | | 6/1998 | Sadlier |

5,769,262 A 6/1998 Yamada et al.
5,769,311 A 6/1998 Morita
5,772,111 A 6/1998 Kirsch
5,794,843 A 8/1998 Sanchez
5,820,016 A 10/1998 Stropkay
5,823,948 A 10/1998 Ross, Jr. et al.
5,839,599 A 11/1998 Lin
5,839,653 A 11/1998 Zadravetz
5,894,948 A 4/1999 Yeh
5,903,889 A 5/1999 de la Huerga et al.
5,913,449 A 6/1999 Branch et al.
5,918,761 A 7/1999 Wissinger
5,944,208 A 8/1999 Gale
5,950,917 A 9/1999 Smith
5,953,419 A 9/1999 Lohstroh et al.
5,954,217 A 9/1999 Brkovic et al.
5,956,400 A 9/1999 Chaum et al.
5,964,400 A 10/1999 Verano et al.
5,975,344 A 11/1999 Stevens
5,996,887 A * 12/1999 Cai et al. ..... 229/400
6,036,801 A 3/2000 Yamada et al.
6,047,488 A * 4/2000 Tuszkiewicz ..... 40/306
6,050,443 A 4/2000 Tung
6,056,144 A 5/2000 Strange et al.
6,065,632 A 5/2000 Moore, Jr.
6,068,181 A * 5/2000 Cai ..... 229/116.1
6,076,699 A 6/2000 Seager et al.
6,085,970 A 7/2000 Sadlier
6,109,518 A * 8/2000 Mueller et al. ..... 229/403
6,116,503 A 9/2000 Varano
6,126,584 A 10/2000 Zadravetz
6,145,656 A 11/2000 Marco
6,148,342 A 11/2000 Ho
6,161,720 A 12/2000 Castle
6,193,098 B1 2/2001 Mochizuki et al.
6,196,454 B1 3/2001 Sadlier
6,210,766 B1 4/2001 McLaughlin
6,224,954 B1 5/2001 Mitchell et al.
6,237,845 B1 5/2001 Hashimoto et al.
6,253,995 B1 7/2001 Blok et al.
6,257,485 B1 * 7/2001 Sadlier et al. ..... 229/403
6,260,021 B1 7/2001 Wong et al.
6,260,756 B1 * 7/2001 Mochizuki et al. ..... 229/402
6,263,330 B1 7/2001 Bessette et al.
6,265,040 B1 7/2001 Neale et al.
6,286,754 B1 9/2001 Stier et al.
6,287,247 B1 9/2001 Dees et al.
6,315,150 B1 11/2001 Takai et al.
6,315,192 B1 * 11/2001 Marlow ..... 229/401
6,332,538 B1 12/2001 Pritchard
6,343,735 B1 2/2002 Cai
6,367,652 B1 4/2002 Toida et al.
6,378,763 B1 4/2002 Nelson et al.
6,378,766 B2 4/2002 Sadlier
6,382,449 B1 5/2002 Kazmierski et al.
6,401,955 B1 6/2002 Yang et al.
6,419,108 B1 7/2002 Toida et al.
6,422,456 B1 7/2002 Sadlier
6,424,996 B1 7/2002 Killcommons et al.
6,449,621 B1 9/2002 Pettovello
6,457,585 B1 10/2002 Huffer et al.
6,463,417 B1 10/2002 Schoenberg
6,557,102 B1 4/2003 Wong et al.
6,557,751 B2 5/2003 Puerini
6,562,270 B1 5/2003 Gannon et al.
6,568,587 B1 5/2003 Yamada et al.
6,574,629 B1 6/2003 Cooke, Jr. et al.
6,574,742 B1 6/2003 Jamroga et al.
6,598,786 B1 7/2003 Guo
6,611,846 B1 8/2003 Stoodley et al.
6,612,456 B1 9/2003 Hundley et al.
6,648,176 B1 11/2003 Donovan
6,651,060 B1 11/2003 Harper et al.
6,663,926 B1 12/2003 Okushita et al.
6,678,703 B2 1/2004 Rothschild et al.
6,678,764 B2 1/2004 Parvulescu et al.
6,688,487 B2 2/2004 Oakes et al.
6,691,134 B1 2/2004 Babula et al.
6,738,798 B1 5/2004 Ploetz et al.
6,746,743 B2 6/2004 Knoerzer et al.
6,749,913 B2 6/2004 Watanabe et al.
6,763,344 B1 7/2004 Osentoski et al.
6,775,670 B2 8/2004 Bessette et al.
6,811,843 B2 11/2004 DeBraai et al.
6,852,381 B2 2/2005 DeBraai et al.
6,908,651 B2 6/2005 Watanabe et al.
6,921,179 B2 7/2005 Diak Ghanem
6,926,197 B2 8/2005 Hed et al.
6,989,198 B2 1/2006 Masuda et al.
7,100,770 B2 9/2006 D'Amato
7,117,579 B2 10/2006 Schellenberg
7,172,086 B2 2/2007 McKendry et al.
7,175,585 B2 2/2007 Okushita et al.
7,195,805 B2 3/2007 Breining et al.
D546,625 S 7/2007 Gluck
D547,122 S 7/2007 Gluck
D550,033 S 9/2007 Bodum
D550,034 S 9/2007 Bodum
D551,502 S 9/2007 Bodum
D553,437 S 10/2007 Bodum
D553,439 S 10/2007 Bodum
D553,440 S 10/2007 Bodum
D553,442 S 10/2007 Bodum
D553,909 S 10/2007 Bodum
D553,910 S 10/2007 Bodum
D553,911 S 10/2007 Bodum
7,281,650 B1 10/2007 Milan
D557,561 S 12/2007 Flowers et al.
D557,563 S 12/2007 Bodum
D557,564 S 12/2007 Bodum
7,306,113 B2 12/2007 El-Saden et al.
D562,075 S 2/2008 Mehta
D563,172 S 3/2008 Bodum
7,344,038 B2 * 3/2008 Elansary ..... 215/12.1
D577,260 S 9/2008 Bodum
7,451,910 B2 11/2008 Frost et al.
7,451,911 B2 11/2008 Stepanek, Jr.
D581,738 S 12/2008 Bodum
D581,739 S 12/2008 Bodum
7,458,504 B2 12/2008 Robertson et al.
7,481,356 B2 1/2009 Stahlecker et al.
7,536,767 B2 5/2009 Hollis et al.
D594,277 S 6/2009 Snell
D595,090 S 6/2009 Benson
7,552,841 B2 6/2009 Hollis et al.
D597,791 S 8/2009 Lion et al.
D597,792 S 8/2009 Lion et al.
7,597,246 B2 10/2009 Stepanek, Jr.
7,631,781 B2 12/2009 Chen
7,677,435 B2 3/2010 Stahlecker
7,694,843 B2 4/2010 Hollis et al.
7,699,216 B2 4/2010 Smith et al.
7,717,325 B2 5/2010 Puls et al.
2001/0013537 A1 8/2001 Sadlier
2001/0032100 A1 10/2001 Mahmud et al.
2001/0041991 A1 11/2001 Segal et al.
2002/0010679 A1 1/2002 Felsher
2002/0043555 A1 4/2002 Mader
2002/0148832 A1 10/2002 Breining et al.
2002/0156650 A1 10/2002 Klein et al.
2002/0172818 A1 11/2002 DeBraal et al.
2003/0029876 A1 2/2003 Giraud
2003/0088441 A1 5/2003 McNerney
2003/0116576 A1 * 6/2003 Lang-Boecker ..... 220/738
2003/0121189 A1 7/2003 Williams
2003/0121963 A1 * 7/2003 Van Handel ..... 229/403
2003/0140044 A1 7/2003 Mok et al.
2003/0226882 A1 12/2003 Porchia et al.
2004/0034550 A1 2/2004 Menschik et al.
2004/0069311 A1 4/2004 Sasaki et al.
2004/0094612 A1 * 5/2004 D'Amato ..... 229/403
2004/0112949 A1 6/2004 Hed et al.
2004/0133797 A1 7/2004 Arnold
2004/0139222 A1 7/2004 Slik et al.
2004/0154156 A1 8/2004 Schellenberg
2004/0199765 A1 10/2004 Kohane et al.
2004/0226948 A1 11/2004 Okushita et al.
2005/0006385 A1 1/2005 D'Amato

| | | | | |
|---|---|---|---|---|
| 2005/0029337 | A1 | 2/2005 | Van Handel | |
| 2005/0040218 | A1 | 2/2005 | Hinchey et al. | |
| 2005/0045643 | A1 | 3/2005 | Ghanem | |
| 2005/0115975 | A1 | 6/2005 | Smith et al. | |
| 2005/0184074 | A1 | 8/2005 | Simmons et al. | |
| 2005/0199697 | A1 | 9/2005 | Nugent | |
| 2005/0205651 | A1 | 9/2005 | Marx | |
| 2005/0236468 | A1 | 10/2005 | Sadlier | |
| 2005/0258225 | A1 | 11/2005 | Martin | |
| 2005/0269390 | A1 | 12/2005 | Martin | |
| 2006/0038001 | A1 | 2/2006 | Stepanek | |
| 2006/0118608 | A1* | 6/2006 | Stahlecker | 229/403 |
| 2006/0131316 | A1 | 6/2006 | Bresler | |
| 2006/0144915 | A1 | 7/2006 | Sadlier | |
| 2006/0186012 | A1 | 8/2006 | D'Amato | |
| 2006/0226210 | A1* | 10/2006 | Stahlecker | 229/403 |
| 2006/0237465 | A1 | 10/2006 | D'Amato | |
| 2006/0283855 | A1 | 12/2006 | Hollis et al. | |
| 2006/0289610 | A1 | 12/2006 | Kling | |
| 2007/0262129 | A1 | 11/2007 | Zadravetz | |
| 2007/0284426 | A1 | 12/2007 | Lo | |
| 2008/0006643 | A1 | 1/2008 | Ma | |
| 2008/0023536 | A1 | 1/2008 | Frost et al. | |
| 2008/0023537 | A1 | 1/2008 | Frost et al. | |
| 2008/0023538 | A1 | 1/2008 | Robertson et al. | |
| 2008/0029588 | A1 | 2/2008 | Messerschmid et al. | |
| 2008/0078825 | A1 | 4/2008 | Puls et al. | |
| 2008/0087677 | A1 | 4/2008 | Robertson et al. | |
| 2008/0087715 | A1 | 4/2008 | Robertson et al. | |
| 2008/0087716 | A1 | 4/2008 | Sadlier | |
| 2008/0093434 | A1 | 4/2008 | Van Handel | |
| 2008/0105692 | A1 | 5/2008 | Hiromori | |
| 2008/0105693 | A1 | 5/2008 | Hechmati | |
| 2008/0121681 | A1 | 5/2008 | Wiedmeyer | |
| 2008/0128433 | A1 | 6/2008 | Stauffer et al. | |
| 2008/0128481 | A1 | 6/2008 | Robertson | |
| 2008/0156857 | A1 | 7/2008 | Johnston | |
| 2008/0169297 | A1 | 7/2008 | Kelly | |
| 2008/0264937 | A1 | 10/2008 | D'Amato | |
| 2008/0272118 | A1 | 11/2008 | Wang | |
| 2008/0280743 | A1 | 11/2008 | Stahlecker et al. | |
| 2008/0302800 | A1 | 12/2008 | Chou | |
| 2008/0308620 | A1 | 12/2008 | Stepanek, Jr. | |
| 2008/0314909 | A1 | 12/2008 | Takeo et al. | |
| 2009/0020597 | A1 | 1/2009 | D'Amato | |
| 2009/0110782 | A1 | 4/2009 | Mellor | |
| 2009/0121007 | A1 | 5/2009 | Van Handel | |
| 2009/0159653 | A1 | 6/2009 | Stahlecker | |
| 2009/0166402 | A1 | 7/2009 | D'amato | |
| 2009/0170680 | A1 | 7/2009 | D'amato | |
| 2009/0184020 | A1 | 7/2009 | Messerschmid et al. | |
| 2009/0218390 | A1 | 9/2009 | Chang | |
| 2009/0230178 | A1 | 9/2009 | Stahlecker et al. | |
| 2009/0294456 | A1 | 12/2009 | Messerschmid | |
| 2009/0294520 | A1 | 12/2009 | Stepanek, Jr. | |
| 2009/0321440 | A1 | 12/2009 | Fedusa et al. | |
| 2009/0321508 | A1 | 12/2009 | Fu et al. | |
| 2010/0025283 | A1 | 2/2010 | Oshima et al. | |
| 2010/0044424 | A1 | 2/2010 | Van Handel | |
| 2010/0065622 | A1 | 3/2010 | Chang | |
| 2010/0072268 | A1 | 3/2010 | Johnson et al. | |
| 2010/0160130 | A1 | 6/2010 | Messerschmid | |
| 2010/0187296 | A1 | 7/2010 | Puls et al. | |

FOREIGN PATENT DOCUMENTS

| | | | |
|---|---|---|---|
| AT | 263709 | T | 4/2004 |
| AU | 4557993 | A | 3/1994 |
| AU | 2008264158 | A1 | 8/2009 |
| AU | 2009200641 | A1 | 10/2009 |
| BE | 410215 | A | 7/1935 |
| BE | 897862 | A1 | 3/1984 |
| BR | PI0900078 | A2 | 9/2009 |
| CA | 742539 | | 9/1966 |
| CA | 837922 | | 3/1970 |
| CA | 844949 | | 6/1970 |
| CA | 1007182 | | 3/1977 |
| CA | 1082657 | | 7/1980 |
| CA | 1125680 | | 6/1982 |
| CA | 1125681 | | 6/1982 |
| CA | 1152011 | | 8/1983 |
| CA | 1239885 | | 8/1988 |
| CA | 1249232 | | 1/1989 |
| CA | 1257209 | | 7/1989 |
| CA | 2021035 | A1 | 1/1991 |
| CA | 2026197 | | 8/1991 |
| CA | 2060135 | | 7/1992 |
| CA | 2150306 | | 2/1996 |
| CA | 2043958 | | 7/1996 |
| CA | 2250677 | | 4/2000 |
| CA | 2286498 | A1 | 4/2000 |
| CA | 2176080 | | 8/2001 |
| CA | 2228749 | | 10/2001 |
| CA | 2141730 | | 5/2002 |
| CA | 2197976 | | 5/2002 |
| CA | 2432791 | | 6/2002 |
| CA | 2165509 | | 7/2002 |
| CA | 2436505 | A1 | 8/2002 |
| CA | 2233356 | | 11/2002 |
| CA | 2431542 | | 12/2002 |
| CA | 2431869 | | 12/2002 |
| CA | 2219845 | | 4/2003 |
| CA | 2244689 | | 9/2003 |
| CA | 2271581 | | 12/2003 |
| CA | 2121491 | | 7/2004 |
| CA | 2542905 | A1 | 1/2005 |
| CA | 2564012 | | 11/2005 |
| CA | 114070 | | 2/2006 |
| CA | 2520024 | | 3/2006 |
| CA | 2262802 | | 6/2006 |
| CA | 2549450 | | 12/2006 |
| CA | 2608826 | | 12/2006 |
| CA | 2262458 | | 1/2007 |
| CA | 2613109 | | 1/2007 |
| CA | 2621453 | | 3/2007 |
| CA | 113773 | | 4/2007 |
| CA | 119089 | | 5/2007 |
| CA | 119090 | | 5/2007 |
| CA | 119091 | | 5/2007 |
| CA | 119092 | | 5/2007 |
| CA | 2629190 | | 5/2007 |
| CA | 118452 | | 7/2007 |
| CA | 113355 | | 9/2007 |
| CA | 115931 | | 10/2007 |
| CA | 116240 | | 10/2007 |
| CA | 116241 | | 10/2007 |
| CA | 116438 | | 10/2007 |
| CA | 119239 | | 10/2007 |
| CA | 120446 | | 10/2007 |
| CA | 2545497 | | 11/2007 |
| CA | 2588413 | | 11/2007 |
| CA | 2657721 | A1 | 1/2008 |
| CA | 116480 | | 2/2008 |
| CA | 2598153 | | 2/2008 |
| CA | 120610 | | 3/2008 |
| CA | 2520677 | | 4/2008 |
| CA | 2664625 | | 4/2008 |
| CA | 2665633 | | 4/2008 |
| CA | 114549 | | 5/2008 |
| CA | 121962 | | 5/2008 |
| CA | 2610053 | | 5/2008 |
| CA | 122120 | | 6/2008 |
| CA | 122879 | | 7/2008 |
| CA | 2267361 | | 10/2008 |
| CA | 2598691 | | 5/2009 |
| CA | 2347777 | | 7/2009 |
| CA | 2706374 | | 7/2009 |
| CA | 2311825 | | 10/2009 |
| CA | 2405786 | | 11/2009 |
| CA | 2394475 | | 1/2010 |
| CA | 128485 | | 2/2010 |
| CH | 678938 | A5 | 11/1991 |
| CN | 1082987 | A | 3/1994 |
| CN | 1128744 | A | 8/1996 |
| CN | 1237133 | A | 12/1999 |
| CN | 1272089 | A | 11/2000 |
| CN | 1288427 | A | 3/2001 |
| CN | 2430371 | | 5/2001 |
| CN | 2484866 | Y | 4/2002 |

| | | | |
|---|---|---|---|
| CN | 2526274 | Y | 12/2002 |
| CN | 1489541 | A | 4/2004 |
| CN | 1781813 | A | 6/2006 |
| CN | 101489771 | A | 7/2009 |
| CN | 101492107 | A | 7/2009 |
| CN | 101531070 | A | 9/2009 |
| DE | 652737 | C | 11/1937 |
| DE | 18806777 | | 5/1963 |
| DE | 11 91 285 | A | 4/1965 |
| DE | 2001499 | | 7/1970 |
| DE | 8301046 | U1 | 5/1983 |
| DE | 3335833 | A1 | 4/1984 |
| DE | 9115069 | U1 | 1/1992 |
| DE | 9215015 | U1 | 1/1993 |
| DE | 59002814 | | 10/1993 |
| DE | 4226313 | | 2/1994 |
| DE | 4393650 | | 11/1995 |
| DE | 44 21 870 | A1 | 1/1996 |
| DE | 59303454 | | 9/1996 |
| DE | 19517392 | | 11/1996 |
| DE | 19517394 | | 11/1996 |
| DE | 19840841 | A1 | 3/2000 |
| DE | 10056811 | A1 | 7/2001 |
| DE | 10054727 | A1 | 5/2002 |
| DE | 20110390 | U1 | 10/2002 |
| DE | 20310623 | U1 | 11/2003 |
| DE | 60102661 | T2 | 8/2004 |
| DE | 102004056932 | A1 | 5/2006 |
| DE | 102005017741 | A1 | 10/2006 |
| DE | 102006025612 | A1 | 11/2007 |
| DE | 102007024243 | A1 | 1/2008 |
| DE | 102007024254 | A1 | 1/2008 |
| DE | 102007030864 | A1 | 1/2008 |
| DE | 102008005403 | A1 | 7/2009 |
| DE | 102008014878 | A1 | 9/2009 |
| EA | 200900031 | A1 | 8/2009 |
| EP | 0074936 | A2 | 3/1983 |
| EP | 0 108 264 | | 10/1983 |
| EP | 0102149 | A2 | 3/1984 |
| EP | 0 371 918 | | 6/1990 |
| EP | 0408515 | A1 | 1/1991 |
| EP | 0512179 | A1 | 11/1992 |
| EP | 0653983 | A1 | 5/1995 |
| EP | 0 659 647 | | 6/1995 |
| EP | 0 683 033 | | 11/1995 |
| EP | 0 688 720 | | 12/1995 |
| EP | 0 695 692 | | 2/1996 |
| EP | 0 765 821 | | 4/1997 |
| EP | 0 812 668 | | 12/1997 |
| EP | 0929455 | A1 | 7/1999 |
| EP | 0934202 | A1 | 8/1999 |
| EP | 0 940 240 | | 9/1999 |
| EP | 1 029 656 | | 8/2000 |
| EP | 1031514 | A1 | 8/2000 |
| EP | 1 060 879 | | 12/2000 |
| EP | 1057733 | A1 | 12/2000 |
| EP | 1 157 943 | | 11/2001 |
| EP | 1203728 | A2 | 5/2002 |
| EP | 1227042 | | 7/2002 |
| EP | 1227042 | A1 | 7/2002 |
| EP | 1227043 | A1 | 7/2002 |
| EP | 1 254 842 | | 11/2002 |
| EP | 1 317 380 | | 6/2003 |
| EP | 1 404 580 | | 4/2004 |
| EP | 1 404 590 | | 4/2004 |
| EP | 1 418 272 | | 5/2004 |
| EP | 1 463 670 | | 10/2004 |
| EP | 1479512 | A2 | 11/2004 |
| EP | 1 486 424 | | 12/2004 |
| EP | 1 512 527 | | 3/2005 |
| EP | 1 547 762 | | 6/2005 |
| EP | 1 637 457 | | 3/2006 |
| EP | 1656300 | | 5/2006 |
| EP | 1 670 688 | | 6/2006 |
| EP | 1712490 | A2 | 10/2006 |
| EP | 1714912 | A1 | 10/2006 |
| EP | 1 719 715 | | 11/2006 |
| EP | 1 739 029 | | 1/2007 |
| EP | 1785370 | A1 | 5/2007 |
| EP | 1 876 106 | | 1/2008 |
| EP | 1 894 847 | | 3/2008 |
| EP | 1 921 023 | | 5/2008 |
| EP | 1 939 099 | | 7/2008 |
| EP | 1975083 | A2 | 10/2008 |
| EP | 1 990 184 | | 11/2008 |
| EP | 2 049 326 | | 4/2009 |
| EP | 2043853 | A1 | 4/2009 |
| EP | 2080715 | A1 | 7/2009 |
| EP | 2108506 | A2 | 10/2009 |
| EP | 2 128 041 | | 12/2009 |
| EP | 2 147 871 | | 1/2010 |
| EP | 2 199 222 | | 6/2010 |
| EP | 2 202 178 | | 6/2010 |
| ES | 2045882 | T3 | 1/1994 |
| ES | 2093443 | T3 | 12/1996 |
| ES | 2218361 | T3 | 11/2004 |
| FR | 791981 | A | 12/1935 |
| FR | 14 90 636 | | 6/1967 |
| FR | 2160489 | A1 | 6/1973 |
| FR | 2533894 | A1 | 4/1984 |
| FR | 2825981 | | 6/2001 |
| FR | 2813861 | A1 | 3/2002 |
| GB | 321176 | A | 10/1929 |
| GB | 0445661 | A | 4/1936 |
| GB | 484990 | A | 5/1938 |
| GB | 1 261 533 | | 1/1968 |
| GB | 1261531 | A | 1/1972 |
| GB | 1261532 | A | 1/1972 |
| GB | 1261533 | A | 1/1972 |
| GB | 1 554 241 | | 10/1979 |
| GB | 2 044 076 | | 10/1980 |
| GB | 2 055 737 | | 3/1981 |
| GB | 2 061 699 | | 5/1981 |
| GB | 2 073 581 | | 10/1981 |
| GB | 2074124 | A | 10/1981 |
| GB | 2 077 177 | | 12/1981 |
| GB | 2 078 094 | | 1/1982 |
| GB | 2130168 | A | 5/1984 |
| GB | 2333087 | A | 7/1999 |
| GB | 2420267 | | 5/2006 |
| GB | 2425041 | A | 10/2006 |
| GB | 2426045 | A | 11/2006 |
| GB | 2445287 | A | 7/2008 |
| HK | 1034700 | A1 | 4/2004 |
| HK | 1063172 | A1 | 8/2006 |
| IT | 1366725 | | 2/2006 |
| IT | MI0020060589 | | 6/2006 |
| JP | 50-67002 | | 10/1948 |
| JP | 52-76459 | | 11/1950 |
| JP | 50052003 | A | 5/1975 |
| JP | 50120802 | A | 10/1975 |
| JP | 51140989 | | 12/1976 |
| JP | 53060441 | | 5/1978 |
| JP | 55134046 | | 10/1980 |
| JP | 56156777 | A | 11/1981 |
| JP | 58-81159 | | 5/1983 |
| JP | 59-94076 | | 5/1984 |
| JP | 60-154235 | | 8/1985 |
| JP | 60-242490 | | 12/1985 |
| JP | 62-143663 | | 6/1987 |
| JP | 2509655 | Y2 | 8/1989 |
| JP | 02-307738 | | 12/1990 |
| JP | 3023014 | U | 3/1991 |
| JP | 4-32908 | | 2/1992 |
| JP | 4097833 | A | 3/1992 |
| JP | 04097833 | A | 3/1992 |
| JP | 4-45215 | | 4/1992 |
| JP | 4-68848 | | 6/1992 |
| JP | 5-84621 | | 11/1993 |
| JP | 06048474 | A | 2/1994 |
| JP | 07-149338 | | 6/1995 |
| JP | 8-207924 | | 8/1996 |
| JP | 8-310571 | | 11/1996 |
| JP | 9-132224 | | 5/1997 |
| JP | 10-175627 | | 6/1998 |
| JP | 10-278931 | | 10/1998 |
| JP | 10-338277 | | 12/1998 |
| JP | 11314286 | A | 11/1999 |

| | | | |
|---|---|---|---|
| JP | 11321936 | A | 11/1999 |
| JP | 11342982 | A | 12/1999 |
| JP | 2000033931 | A | 2/2000 |
| JP | 2000095228 | A | 4/2000 |
| JP | 2000103478 | A | 4/2000 |
| JP | 2000103479 | A | 4/2000 |
| JP | 2000118520 | A | 4/2000 |
| JP | 3063644 | | 5/2000 |
| JP | 2000-203664 | | 7/2000 |
| JP | 2000190943 | A | 7/2000 |
| JP | 2000203664 | A | 7/2000 |
| JP | 2000-238739 | | 9/2000 |
| JP | 2000-281044 | | 10/2000 |
| JP | 2000281044 | A | 10/2000 |
| JP | 2001-2051 | | 1/2001 |
| JP | 01-98355 | | 4/2001 |
| JP | 2001097355 | A | 4/2001 |
| JP | 2001171642 | A | 6/2001 |
| JP | 2001180647 | A | 7/2001 |
| JP | 2001293802 | A | 10/2001 |
| JP | 2001294282 | A | 10/2001 |
| JP | 3248718 | A | 2/2002 |
| JP | 3274412 | A | 4/2002 |
| JP | 2002-128049 | | 5/2002 |
| JP | 2003276721 | A | 10/2003 |
| JP | 2003276738 | | 10/2003 |
| JP | 2004090928 | A | 3/2004 |
| JP | 2004090929 | A | 3/2004 |
| JP | 2004-1892 | | 4/2004 |
| JP | 2004-98663 | | 4/2004 |
| JP | 2004-99079 | | 4/2004 |
| JP | 2004161375 | A | 6/2004 |
| JP | 2004522654 | T | 7/2004 |
| JP | 2004-314987 | | 11/2004 |
| JP | 2004315065 | A | 11/2004 |
| JP | 2006143331 | A | 6/2006 |
| JP | 2006290366 | | 10/2006 |
| JP | 2006298391 | | 11/2006 |
| JP | 2008-529549 | | 8/2008 |
| JP | 2009173346 | A | 8/2009 |
| KR | 2006056859 | | 5/2006 |
| NL | 42544 | C | 2/1938 |
| NZ | 506739 | | 11/2001 |
| NZ | 519160 | | 12/2003 |
| SG | 0117419 | A1 | 12/2005 |
| TR | 200400866 | T4 | 6/2004 |
| TW | 393427 | B | 6/2000 |
| TW | 399609 | Y | 7/2000 |
| WO | WO9202421 | | 2/1992 |
| WO | WO 9308084 | | 4/1993 |
| WO | 9403326 | A1 | 2/1994 |
| WO | 9832601 | A2 | 7/1998 |
| WO | 9911526 | A1 | 3/1999 |
| WO | 9922686 | A1 | 5/1999 |
| WO | 9959883 | A1 | 11/1999 |
| WO | 0017058 | A1 | 3/2000 |
| WO | 0028288 | A1 | 5/2000 |
| WO | WO 01/38180 | | 5/2001 |
| WO | 0204300 | A1 | 1/2002 |
| WO | WO 02/30783 | | 4/2002 |
| WO | 0247523 | A1 | 6/2002 |
| WO | 02060767 | | 8/2002 |
| WO | 03057577 | | 7/2003 |
| WO | WO 2004/049924 | | 6/2004 |
| WO | WO 2004/103845 | | 12/2004 |
| WO | WO 2005/012114 | | 2/2005 |
| WO | WO 2005/047126 | | 5/2005 |
| WO | 2005054082 | A1 | 6/2005 |
| WO | WO 2005/053487 | | 6/2005 |
| WO | 2005075319 | A1 | 8/2005 |
| WO | 2005100167 | A1 | 10/2005 |
| WO | WO 2005/102847 | | 11/2005 |
| WO | 2007028623 | A1 | 3/2007 |
| WO | WO 2007/036928 | A3 | 4/2007 |
| WO | 2007054179 | A2 | 5/2007 |
| WO | 2007054318 | A1 | 5/2007 |
| WO | WO 2007/078446 | A2 | 7/2007 |
| WO | WO 2007/090415 | A1 | 8/2007 |
| WO | WO 2007/091068 | A2 | 8/2007 |
| WO | WO 2007/094838 | A2 | 8/2007 |
| WO | WO 2007/126783 | A1 | 11/2007 |
| WO | 2008009371 | A1 | 1/2008 |
| WO | 2008009372 | A1 | 1/2008 |
| WO | WO 2008/009372 | | 1/2008 |
| WO | WO 2008/014230 | | 1/2008 |
| WO | WO 2008009371 | | 1/2008 |
| WO | WO 2008/022180 | A2 | 2/2008 |
| WO | WO 2008/026161 | A2 | 3/2008 |
| WO | WO 2008/042378 | A1 | 4/2008 |
| WO | WO 2008/045708 | A1 | 4/2008 |
| WO | WO 2008/045944 | A2 | 4/2008 |
| WO | 2008067865 | A1 | 6/2008 |
| WO | WO 2008/107657 | A1 | 9/2008 |
| WO | WO 2008/119938 | A1 | 10/2008 |
| WO | WO 2008/123783 | A1 | 10/2008 |
| WO | WO 2008/146115 | A1 | 12/2008 |
| WO | WO 2009/021305 | A2 | 2/2009 |
| WO | WO 2009/032837 | A1 | 3/2009 |
| WO | WO 2009/034323 | A2 | 3/2009 |
| WO | WO 2009/039632 | A1 | 4/2009 |
| WO | WO 2009/059352 | A1 | 5/2009 |
| WO | WO 2009/074285 | A2 | 6/2009 |
| WO | 2009092557 | A1 | 7/2009 |
| WO | WO 2009/082660 | A1 | 7/2009 |
| WO | WO 2009/092557 | | 7/2009 |
| WO | WO 2009092557 | | 7/2009 |
| WO | WO 2009/118772 | A1 | 10/2009 |
| WO | WO 2010/008629 | A1 | 1/2010 |
| WO | WO 2010/011627 | A1 | 1/2010 |
| WO | WO 2010/019146 | A1 | 2/2010 |
| WO | WO 2010/031764 | A2 | 3/2010 |
| WO | WO 2010/034869 | A1 | 4/2010 |
| WO | WO 2010/036645 | A1 | 4/2010 |
| WO | WO 2010/067047 | A1 | 6/2010 |

OTHER PUBLICATIONS

Statement of Case in Support of Notice of Opposition to Grant of Patent (Section 21) in New Zealand Patent Application No. 543602, Mar. 28, 2007, 16 pages.

International Search Report from International Application No. PCT/EP2006/009933, dated Oct. 4, 2007, 5 pages.

International Search Report mailed Jan. 15, 2007, in PCT/EP2006/008753.

International Search Report from Corresponding International Application No. PCT/EP2005/005406, dated Aug. 25, 2005, 2 pages.

Search Report for DE 203 19 691.0 mailed Aug. 24, 2004.

Notice of Opposition dated Jan. 27, 2012 for EP Application No. 07018949.3.

Opposition against grant of a patent of the Russian Federation No. 2402471 for the invention "A Package" mailed May 5, 2011.

Decision—Minutes of the oral proceedings before the Opposition Divisin in EP-B-1785370, Dated Nov. 2, 2010.

EPO Communication dated Oct. 20, 2010, based on EP1976683.

Notice of Reasons for Rejection from the Japanese Patent Office in Japanese Patent Appln. No. 2008-539346, Dated Feb. 18, 2011.

Second Office Action from The State Intellectual Property Office of P.R. China, dated Mar. 21, 2011, for Appln. No. 200480025553.7, issued as 2011031600528500.

European Search Report dated Sep. 30, 2010, based on EP10008013.

European Search Report dated Sep. 30, 2010, based on EP10008011.

European Search Report dated Sep. 30, 2010, based on EP10008012.

Office Action dated Jul. 1, 2011, corresponding to Mexican Appln. No. 51543.

European Office Action dated Jan. 17, 2011 with English Summary, based on U.S. Appl. No. 10/630,377.

* cited by examiner

PACKAGE

RELATED APPLICATIONS

Applicant claims, under 35 U.S.C. §119, the benefit of priority of the filing date of Dec. 5, 2006, of German patent application, Serial No. 20 2006 018 406.6, a copy of which is enclosed. The entire contents of the priority application are incorporated herein by reference.

The present invention refers to a multi-layered package and particularly to a container comprising a container opening and a container bottom, wherein preferably at least one outer wall comprises a predetermined removable wall section revealing an information.

The state of the art discloses packages, which are provided with a label designated to reveal at first hidden information to the public. For this purpose, the user grasps the label or at least part of same and peels it off. Due to the peeling off, the information became public hidden and it may be located on the inner side of the label or on the outer side of a layer that was originally located underneath same. The information may also be a piece hidden behind the label, e.g. a sticker.

Different types of packages are known from DE 697 12 370T2 and DE 698 07 259T2.

In a package according to DE 697 12 370 T2 a multi-layered label is arranged on the surface of the package, wherein one label or a plurality of labels are arranged in parallel on the surface, which are affixed or may be peeled off from the label.

Further, a different type of multi-layered package is known from practice, wherein a drinking container, namely a cup, is combined with an insulating casing. Both predominantly consist of cardboard and are manufactured separately. The insulating casing has a corrugated surface for the purpose of insulation and is loosely slid over the cup from the bottom before filling the cup. The casing may serve as a carrier of an information, e.g. advertisement. Since it is not durably connected to the cup, it can be removed therefrom.

This package is a simple solution, however, it has the disadvantage that the casing is separated from the drinking container and must be assembled by the sales personnel of a sales stand before handing it out to the customer so that both a separate storage as well as assembly work is required to bring the package to the final form.

The invention is based on the object to provide a cost-effective and simpler package of the above-mentioned type at the same time. This object is solved by the characterizing features of the main claim.

The removable wall section is formed as a card and is firstly an integrated component of at least the outer wall. Due to appropriate measures it is prepared to unhinge from the package particularly easy and without interference of the other components when grasped by the user. When the wall section itself serves as a carrier of information, and if maybe furthermore it is desired to obtain it in a predetermined shape during a certain using period, it may be built from a relatively resistant material. Advantageously, the outer wall of the package is made of the same material.

In this regard, paper, cardboard, plastic or the like are known, wherein the material these materials may be coated if this is essential for the purpose of the package. This applies especially for food and their respective packages.

Thus, the wall section itself may serve as a carrier of information. Alternatively, after unhinging the same, it may expose the information which it has originally covered. To facilitate the unhinging of the wall section for the user it is possible to choose the material of the wall section and/or the outer wall so that the user may remove the wall section from the composite.

For the purpose of disclosing the information, the wall section may either be partially or completely removed. In the first case, it is still connected with the wall. In the other case, it is completely separated from the wall. While removing the wall section, in both cases a window is opened within the outer wall for the viewer.

The package may be used for serving people, especially in gastronomy (for example in snack bars), to contain food or beverages. Since in this application area the production costs are very important, the package may be formed of paper, cardboard, plastic or the like.

Minimally, the package exists of two walls, i.e. an inner and an outer wall, which are advantageously separated from each other for the purpose of insulation. Due to the space, an insulation space is formed between the walls, which may also be separated from the surrounding to hold the fluid contained therein, in particular air.

During use, the good insulation values that arise bring the advantage that freshly brewed coffee may be filled in such a double-wall package, especially a cup. The user is then able to grasp the package with the hand, even though the coffee still has a high temperature.

The wall section formed as a card may also be relatively stiff, like the outer wall of the package, to facilitate the unhinging of the outer wall and to provide it with a certain durability for the prospective use.

Furthermore, the package, and especially a package having a wall section provided on the outer wall, provides a further information carrier, which requires cooperation of the consumer in that the consumer identifies the wall section, understands its function and opens the wall section to reach the additional information.

Thus, this embodiment of the invention solves two reluctant objects, namely the optimization of the insulation and the provision of an initially covered and inaccessible additional information.

The removable wall section is formed as part of the package which still ensures a sufficient insulation of the product located within the package. Furthermore, the outer wall at the same time serves as a second wall of the double-walled cup and also ensures dimensional stability when the wall section is removed to reach the additional information. Caused by the spacing of the two walls, the wall section can furthermore especially simply be removed, since it is not connected to the inner wall. This facilitates handling of the wall section to the user.

Due to the fact that the wall sections is also formed as part of the package, rising costs in the production process can be avoided, since additional working steps to produce and attach the wall section do not accrue.

Advantageously, a predetermined braking line may determine the size, shape and position of the wall section. This enables a fast and clean separation of the wall section from the outer wall in the size, shape and position desired by the manufacturer.

The shape of the wall section may substantially be square, rectangular, round, oval or trapezoidal. These shapes have proven to be especially simple and cost-effective in manufacture and enable a simple removal from the cup wall. Of course, other shapes are also conceivable.

In an advantageous embodiment of the invention, the wall section is rectangular and has a length L and a width B. The length L extends in the peripheral direction and the width B extends in the direction of the envelope. With this arrangement of the wall section in the direction of the alignment axes of the cup, the wall section may be removed or separated particularly easy and simple from the outer wall.

In a further embodiment of the invention, the predetermined breaking line may be supplemented by a bending line, which connects both ends of the predetermined braking line with one another. Thereby it can be prevented that the wall section is completely separated from the cup wall. Thus, the wall section remains attached on the cup.

In an especially advantageous embodiment of the invention, the predetermined breaking line of the wall section may substantially be formed as a perforation. The perforation allows a quick separation of the wall section from the outer wall. If a part of the predetermined breaking line does not have a perforation, the separated surface of the wall section is smooth in this area and does not have any perforation webs.

In an advantageous embodiment of the invention, the wall section may be provided with an imprint at an inner and/or outer side. Therefore, advertisement may be applied e.g. on one side of the wall section and on the other side of the wall section, a collection card, or a valued customer bonus card may be imprinted.

In an advantageous embodiment of the invention, a substantially peripheral imprint may be arranged on the outer side of the inner wall. Thereby it can be ensured that the imprint is visible in any arrangement of the cups with respect to each other through the open wall section. A precise placing of the outer cup with respect to the inner cup can therefore be dispensed with.

In an especially advantageous embodiment of the invention, at least the outer wall of the cup may be composed of a two-dimensional pre-cut part, which can be connected with itself. This structure represents a cost-effective and fast production of the cup with the removable wall section.

In a favorable embodiment of the invention, the wall section may extend at the outer wall around the circumferential direction of the cup. Since the cup is enclosed when being used by a hand of a user in the peripheral direction of the cup, and thus the cup bottom and the cup opening are aligned vertically, removal of the wall section from the outer wall is facilitated to the user by the positioning in the circumferential direction.

In an advantageous embodiment of the invention, the wall section may adjoin an edge of the pre-cut part extending in the envelope direction of the cup. This facilitates removal of the wall section if the pre-cut part is connected with itself, since the portion of the wall section adjoining the edge projects due to the material properties and can therefore easily be held by the user.

In a further embodiment of the invention, the wall section may project over the edge of the pre-cut part in an overlapping manner and form a handle. If the wall section shall be removed, this flap can be gripped very easily and accelerate the removal process.

In an especially preferred embodiment of the invention, an access section may adjoin the wall section at an overlapping portion of the pre-cut part. This access section may be formed such that a portion is cut out in the central portion of the end edge of the pre-cut part, said portion being formed by two edges extending substantially in parallel with respect to another, standing vertically on the end edge, and by the adjoining wall section. If the pre-cut part is connected with itself, the material of the pre-cut part does not overlap in the area of the access section, and caused by the recess produced thereby with respect to the circumferential wall of the cup, the wall sections can more easily be lifted by the fingers of the user and be separated.

In a further embodiment of the invention, the pre-cut part may have a holder adjacent to the wall section to open the wall section more easily. This holder may be a handle attached at the wall section, such as a flap. By such a device, the gripping and removal of the wall section is significantly facilitated for the user.

In an especially advantageous embodiment of the invention, the length L of the wall section may be larger than the width B, wherein the length L extends in the peripheral direction. The ratio of the two dimensions with respect to one another may have an influence on the tear-off behavior of the wall section. Since the length L is larger than the width B, and the length L extends in the circumferential direction, the advantage also results that the tear-off position is improved for the needs of the user.

In a further embodiment of the invention, the wall section may be arranged in a manner inclined at an angle $\alpha$. Caused by the inclined arrangement of the wall section, the tear-off behavior of the wall section may on the one hand be improved and furthermore, any number of orientations of the imprint on the inner wall can be carried out, said imprint always being visible through the opening of the wall section.

On the other hand, the length L of the wall section may also be arranged in the direction towards the surface line of the cup so that the user is capable of removing the wall section also if the package has a position other than the above described position of use.

It is favorable if the axis of symmetry of the wall section in the peripheral direction of the package forms a point of intersection with an edge of the wall section, said edge adjoining the access section and being particularly rounded. The position of the wall section and of the point of intersection with respect to the axis of symmetry is variable depending on the angle $\alpha$. Since the wall section is rounded in this area, the unsymmetrical arrangement can optically not be recognized. Furthermore, an advantageous tear-off position of the wall section can be produced by this arrangement.

An embodiment of the invention will now be described by means of the following drawings.

Figure 1:
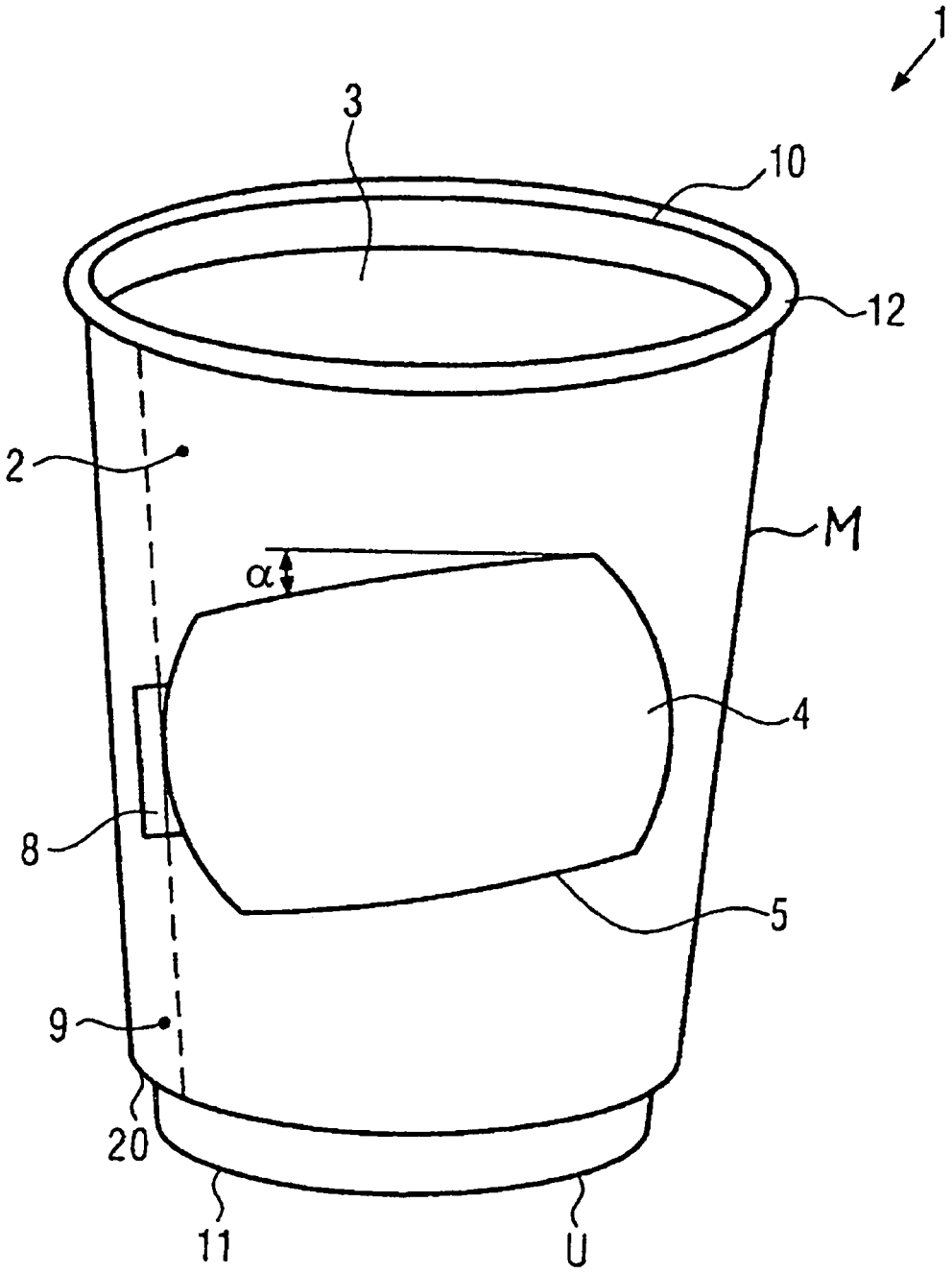
FIG. 1 shows a first embodiment of the package.

FIG. 1 shows a front view of a package according to the invention in the form of a cup, having an inner wall 3 and an outer wall 2 and a wall section 4 formed as part of the outer wall 2. The inner wall 3 is composed of a two-dimensional pre-cut part, which is connected with itself. The outer wall 2 is composed of a two-dimensional pre-cut part 6, which is connected in an overlapping portion 9 with itself during manufacture of the cup. The inner wall 3 is arranged with its lower end at a spacing to the lower end of the outer wall 2, wherein this lower end is formed as container bottom 11 through a bottom portion. The outer dimensions of the inner wall 3 are smaller than the outer dimensions of the outer wall 2 so that the inner wall 3 is arranged in the outer wall 2 and the insulation space 20 between the inner wall 3 and the outer wall 2 serves for the thermal insulation of the double-walled cup 1 and is filled by a fluid and particularly by gas. The cup 1 has a container opening 10 opposite to the container bottom 11. At this container opening 10 an outwardly crimped mouth roll is arranged, which is formed as part of the inner wall 3 and which encircles the outer wall 2. The inner wall 3 and the outer wall 2 are connected to one another in the area of the container opening and taper at a predetermined angle in the direction of the container bottom 11 so that the shape of a truncated cone is produced in whose bottom portion the inner wall 3 and the outer wall 2 are also connected. Caused by this structure, the double-walled cup obtains a dimensionally stable shape.

The outer wall 2 has a wall section 4 in form of a card, which in a preferred embodiment has a perforated predetermined breaking line 5. This predetermined breaking line 5 is attached during the manufacture of the two-dimensional pre-cut part 6. The size, shape and position of the wall section 4 at the outer wall 2 is optionally variable. The predetermined breaking line 5 may also be a predetermined breaking line 5 whose weakening portion separates the wall section 4 from the outer wall 2. An access section 8 may be arranged at an edge 7 of the pre-cut part 6 in the overlapping portion of the pre-cut part 6. As may be seen in FIG. 5, the pre-cut part 6 is cut out in the area of the access section 8.

If during manufacture of the cup 1, the pre-cut part 6 is connected with itself, so that the edges 7 form an overlapping portion 9, the wall section 4 provided in the outer wall 2 in form of a card, projects in the area of the access section 8. This projecting portion serves for opening the wall section 4 with the fingers of the user more easily. By slightly lifting this portion, the perforation of the predetermined breaking line 5 is damaged and an aimed separation of the wall section 4 along the predetermined breaking line 5 is carried out in the case of a further effect of power.

The portion which serves for lifting the wall section 4 does not have a perforation in the area of the access section 8.

The wall section 4 in form of a card is imprinted on one side and/or on both sides. FIG. 1 shows the imprinted outer wall 2 of the cup with an imprinted wall section 4.

Figure 2:
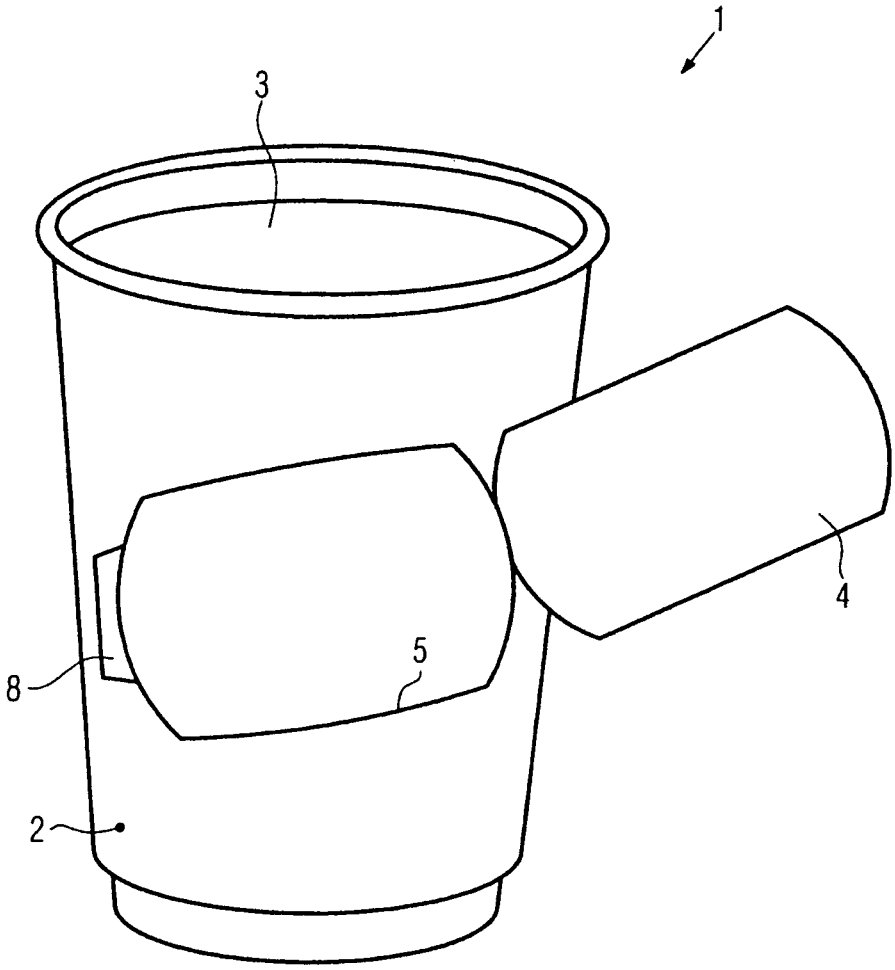
FIG. 2 shows a package according to FIG. 1 with a wall section being formed as part of the outer wall, said wall section being partially detached.

FIG. 2 shows the partially separated wall section 4 at the outer wall 2 of the cup 1. The wall section 4 has a perforated predetermined breaking line. The separation of the wall section 4 formed as a card, from the outer wall 2 does not damage the inner wall 3 of the cup 1. The side of the wall section 4 located in the interior of the cup 1 is also imprinted. For a user the imprint only becomes visible if the wall section 4 is removed from the outer wall 2 of the cup 1.

If the predetermined breaking line 5 of the wall section 4 is not formed along the entire periphery, a separation process does not completely remove the wall section 4 from the outer wall 2 of the cup 1. The wall section 4 remains connected to the outer wall 2 at least in parts.

In the following FIGS. 3 to 9 different embodiments of the wall section 4 according to FIG. 1 are shown. In these Figures, as well as in all other Figures, identical parts are characterized by identical reference numerals and they are only mentioned partially in connection with a Figure.

Figure 3:
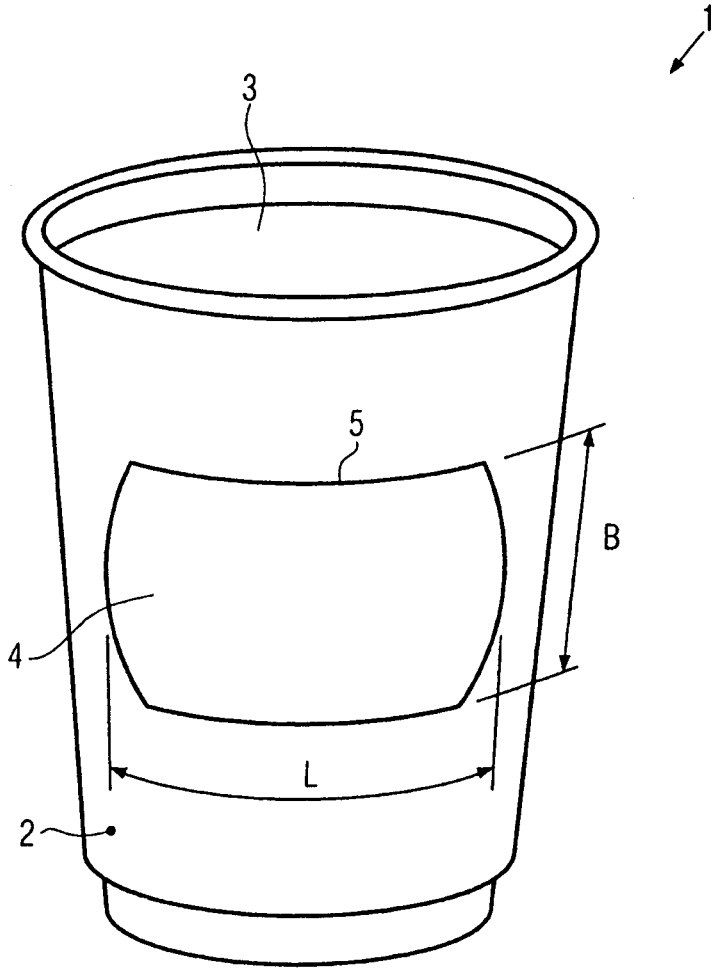
FIG. 3 shows a package according to FIGS. 1 and 2, wherein the wall section is detached and removed from the outer wall.

FIG. 3 shows a preferred embodiment of the wall section 4 formed as a card in the outer wall 2 of the cup 1. The wall section 4 has the dimension length L and width B, wherein the length L is larger than the width B. The length L extends in the peripheral direction U of the cup 1. The two shorter edges have a rounded shape, whereby on the one hand the outer appearance of the wall section 4 is influenced and on the other hand gripping the wall section 4 by the user is facilitated. The wall section 4 is arranged such that the long edges extend in parallel to the container opening 1. The wall section 4 may, however, also be arranged at any angle with respect to the container opening 10.

Figure 4:
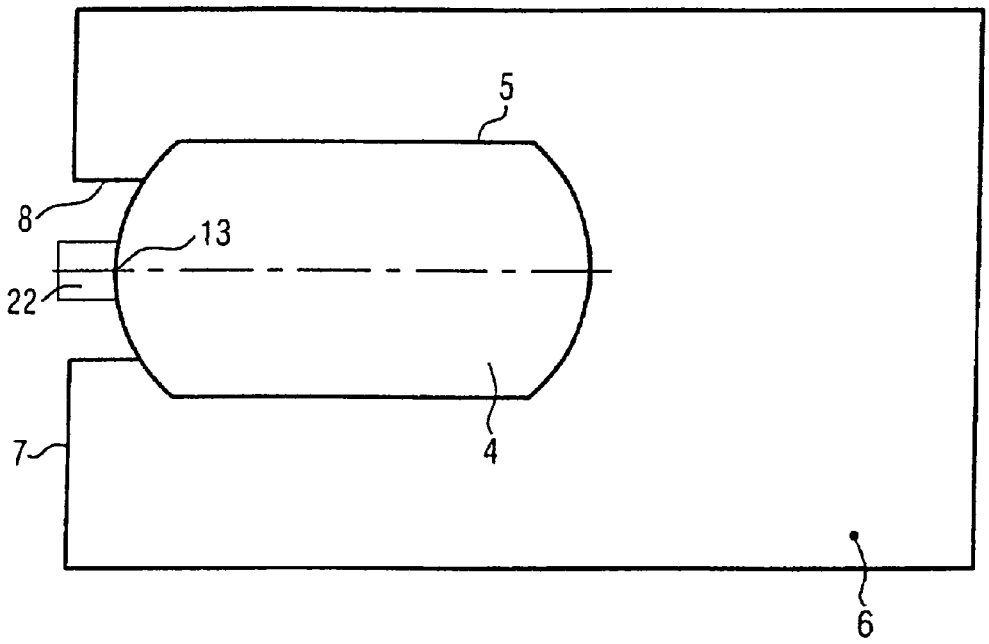
FIG. 4 shows a two-dimensional pre-cut part of an outer wall for a package according to FIG. 1 to 3, wherein the access section was cut out.

FIG. 4 shows a two-dimensional pre-cut part 6 of the outer wall 2, which is connected with itself and which together with an inner wall 3 forms a double-walled cup 1. The wall section 4 in the form of a card is formed by means of a predetermined breaking line 5 in the pre-cut part 6. An access section 8 is cut out at the edge 7 of the pre-cut part so that the access section 8 forms two edges extending perpendicular with respect to the edge 7 and adjoining the wall section 4. The material of the access section 8 is removed from the pre-cut part 6. The axis of symmetry of the wall section 4 in the peripheral direction U of the package 1 forms a point of intersection 13 with an edge of the wall section 4 that adjoins with the access section 8. The wall section 4 projects over the edge 7 of the pre-cut part 6 in an overlapping manner and forms a flap serving as a holder 22.

Figure 5:
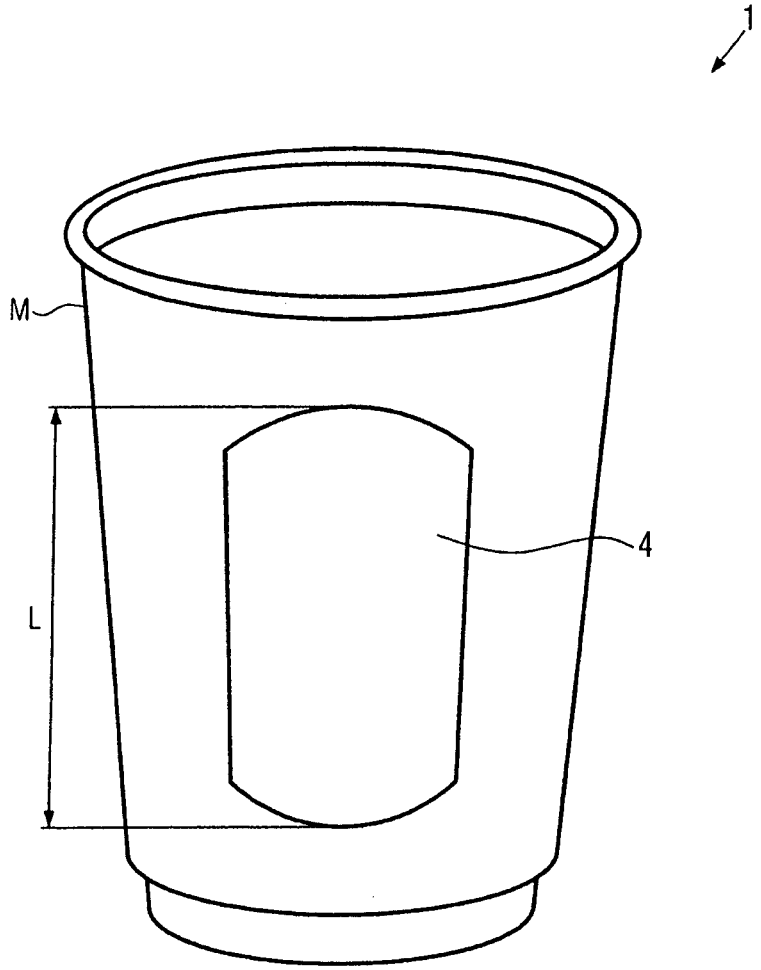
FIG. 5 shows a second embodiment of the package.

FIG. 5 shows a wall section 4 as in FIG. 4 whose long edges extend in the direction of the envelope direction M of a cup 1. This embodiment does not have an access section 8 in the overlapping portion 9.

Figure 6:
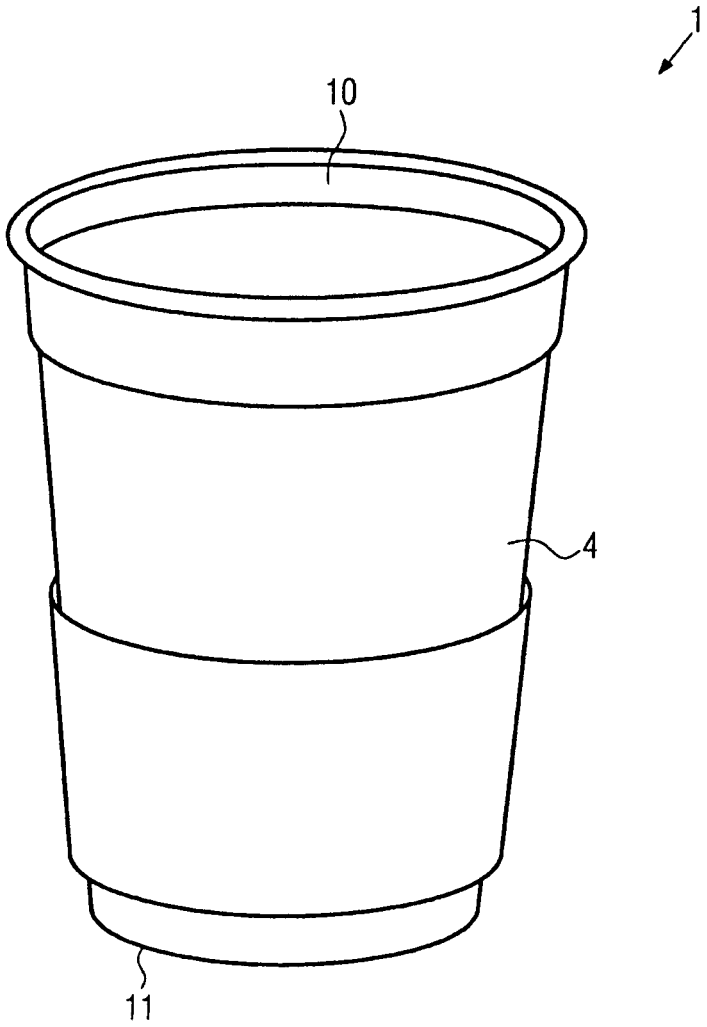
FIG. 6 shows a third embodiment of the package.

In FIG. 6 the wall section is arranged peripherally in the peripheral direction U of the cup 1. The distance of the wall section 4 to the container opening 10 and to the container bottom 11 is optional.

Figure 7:
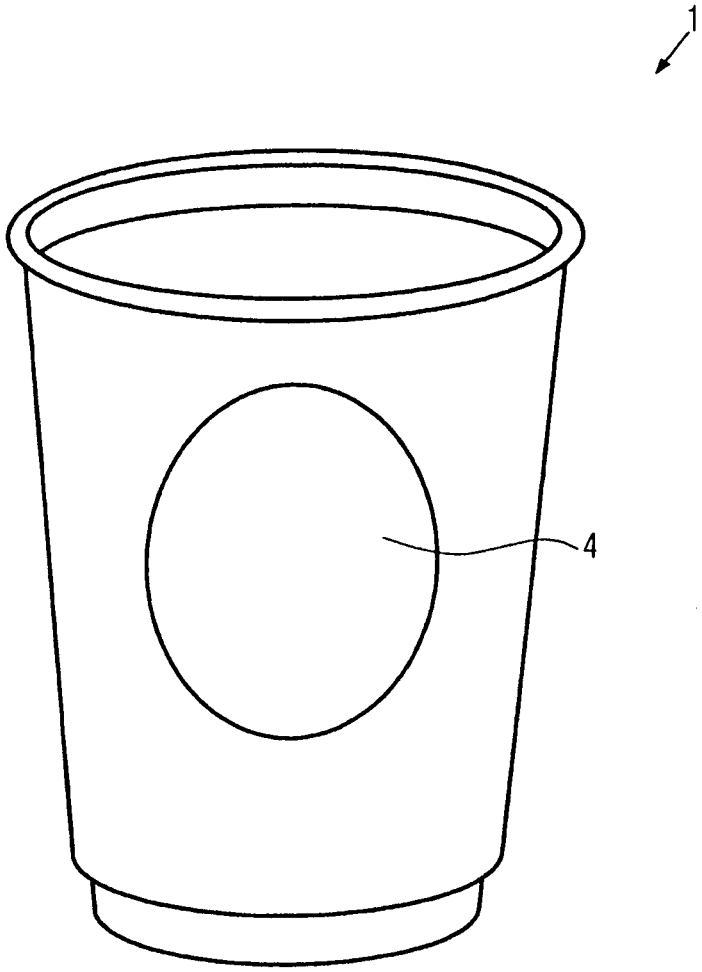
FIG. 7 shows a fourth embodiment of the package.

In a further embodiment the wall section 4, as shown in FIG. 7, has an oval shape. The size and position of the oval contour are optionally arranged at the outer wall 2 of the cup 1.

Figure 8:
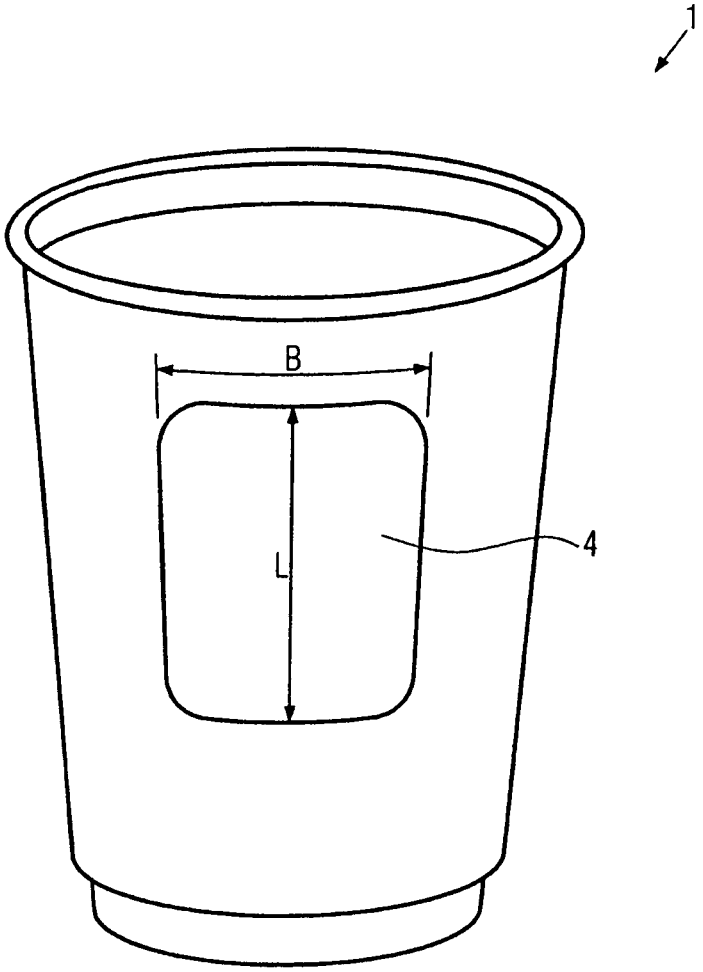
FIG. 8 shows a fifth embodiment of the package.

FIG. 8 shows a further embodiment of the wall section 4 with a dimension length L and width B. The length L in this embodiment is larger than the width B so that a rectangular wall section 4 is produced. The length L may also be equally large as the width B so that a square wall section 4 is produced. The corners of the wall section 4 are rounded.

Figure 9:
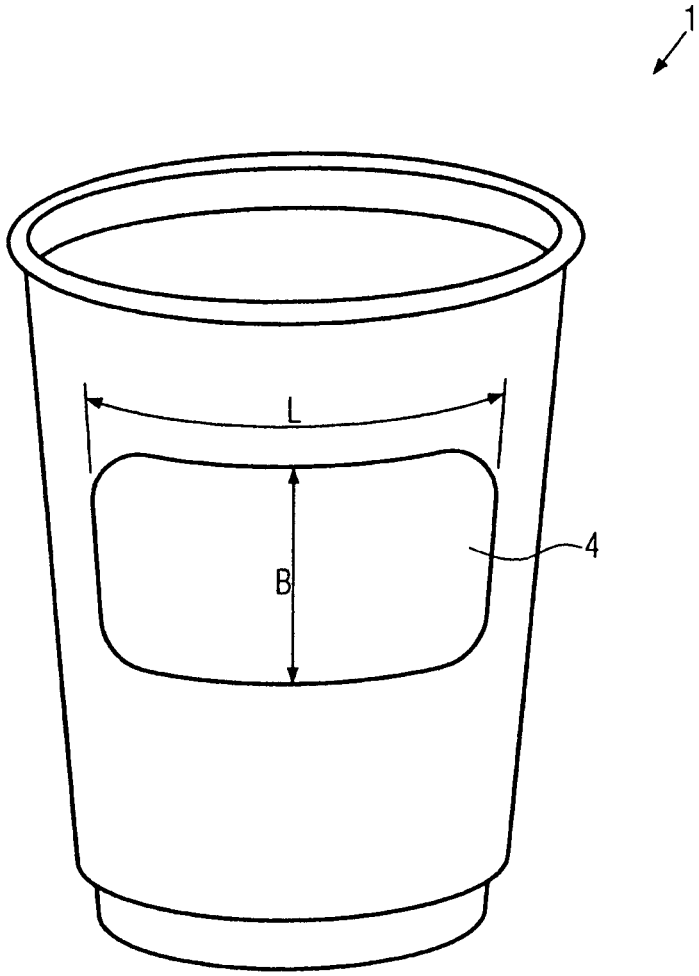
FIG. 9 shows a sixth embodiment of the package.

FIG. 9 shows a further embodiment of the wall section 4 according to FIG. 8, wherein the length L extends in the peripheral direction U and the width B extends in the envelope direction M. The edges of the wall section 4 are rounded.

The inner wall 3 and the outer wall 2 are arranged in any orientation with respect to one another and are connected to one another through the mouth roll 12 at the container opening 10 as well as at the container bottom 11. The inner wall 3 has a peripheral imprint so that this imprint can always be seen as soon as the wall section 4 is removed from the outer wall 2.

In a preferred embodiment, the wall section 4 formed as a card is imprinted on both sides. On the outer wall 2 of the cup 1, which is gripped by user, advertisement or the reference to a certain action is imprinted. After the wall section 4 is separated from the outer wall 2, the user can also look at the side of the wall section 4 which was up to then located in the cup. On the rear side of the wall section 4, advertisement or a collector card for bonus points may for instance be imprinted. The wall section 4 separated from the cup 1 then serves as a collector card for bonus points, which are for instance arranged on the outer wall 2 of the cup 1 in the form of stickers.

It must also be noted that further options for the shape and the imprint of the wall section 4 are possible. One option is for instance that the shape corresponds to a company logo or has any other geometric shape.

The outer wall 2 is substantially made of paper, cardboard or the like and can therefore be imprinted more easily, wherein this imprintability can even be improved by a plastic foil e.g. of polyethylene attached on the outer side. The inner wall 3 is substantially formed of paper, cardboard or the like and additionally has a plastic layer for sealing the package.

Figure 10:
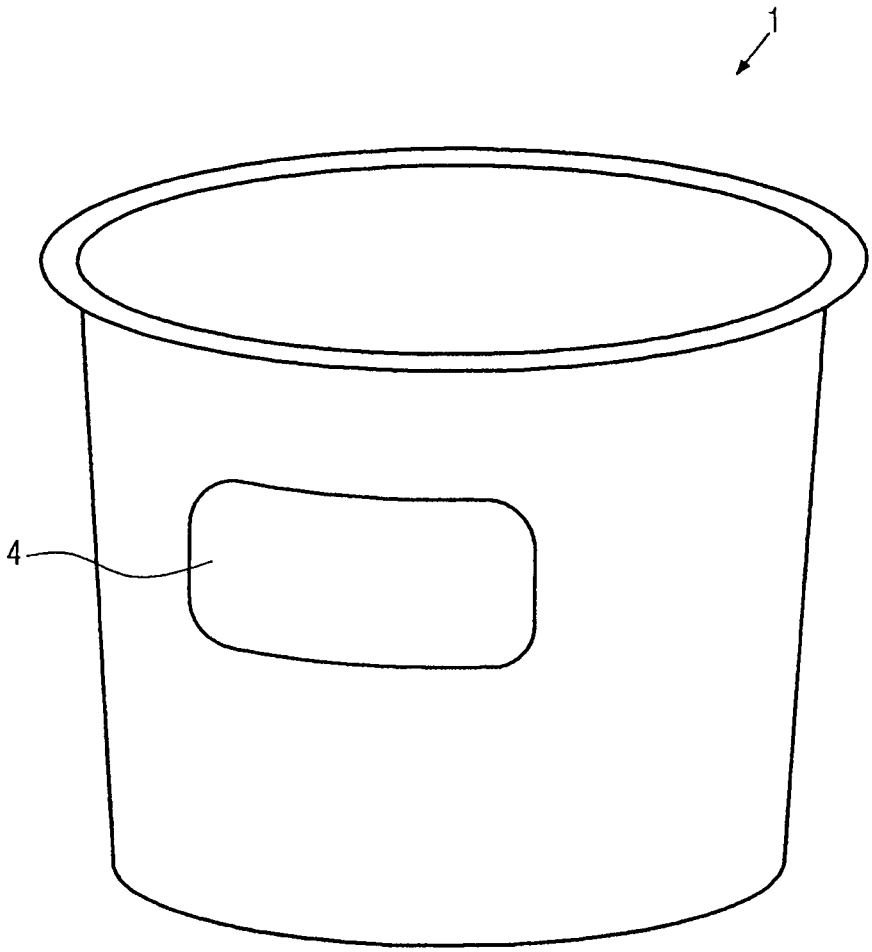
FIG. 10 shows a seventh embodiment of the package.

Starting from the explained embodiment, the package may be modified in several ways. For example, the form of the package, and especially of a container, may vary so that an oval, rectangular or cylindrical container is formed (FIGS. 10, 11 and 12).

Furthermore, the inner and/or the outer wall may be formed of a fluid tight material, as for example plastic.

The wall section may be located in a corner area of a rectangular container so that an edge of the wall section protrudes beyond and forms an overlap, which facilitates the separating of the wall section.

Figure 11:
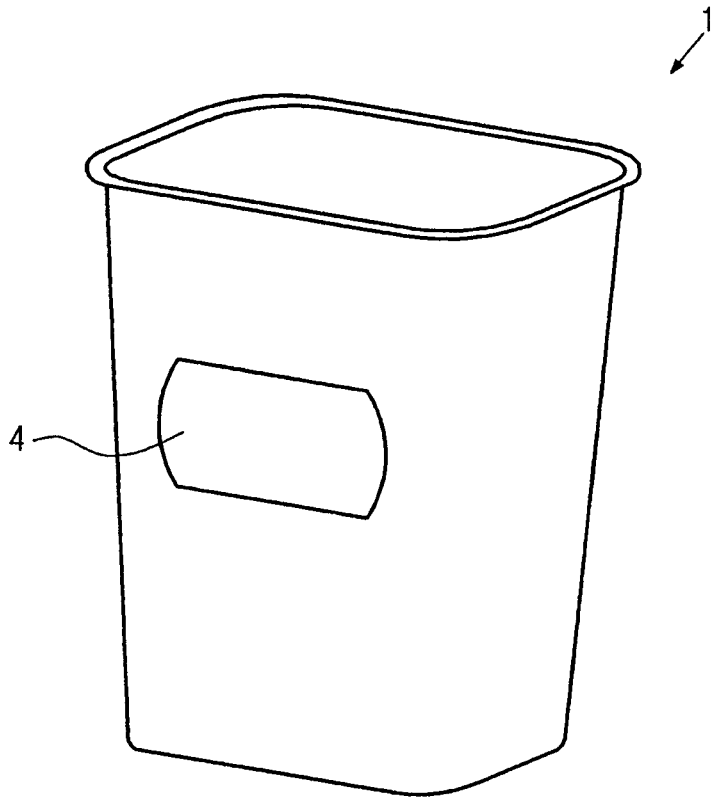
FIG. 11 shows a eighth embodiment of the package.
Figure 12:
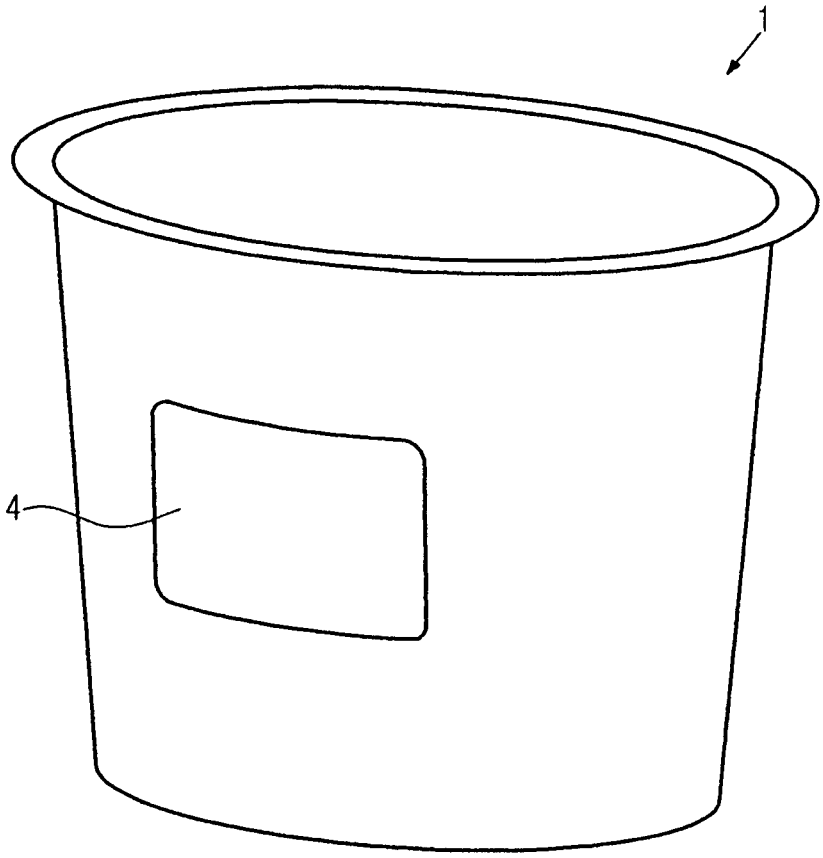
FIG. 12 shows a ninth embodiment of the package.

In a rectangular container according to FIG. 11, an overlap of the two-dimensional blank may be located on a lateral surface of the prism as well as in the corner areas, which may also comprise a radius.

The invention claimed is:

1. A multi-layered container comprising one inner wall, one outer wall, an opening and a bottom, the outer wall comprises a predetermined removable wall section which discloses an information, the removable wall section comprising a rounded short edge having a corner at each end, the short edge being connected to a longer edge at each of the corners, the inner wall and the outer wall being spaced apart from each other to form an annular insulation space comprising a continuous gas-filled gap between the inner wall and the outer wall, said inner and outer walls are connected to each other only in an area of the container opening and the container bottom, and the removable wall section is a one-piece removable card that is not in contact with the inner wall, extends at the outer wall in a peripheral direction of the container and can be adjoined at an edge of a pre-cut part, said edge extending in a direction from the bottom of the container toward the opening in the container and the removable wall section projects over the edge of the pre-cut part in an overlapping manner and forms a flap serving as a holder.

2. The multi-layered container as claimed in claim 1, wherein an access section is adjacent to the removable wall section at an overlapping portion of the pre-cut part.

3. The multi-layered container as claimed in claim 2, wherein the length (L) of the removable wall section is larger than the width (B), and wherein the length (L) extends in the peripheral direction of the container.

4. The multi-layered container as claimed in claim 2, wherein the removable wall section is arranged inclined with respect to the peripheral direction (U) at an angle $\alpha$.

5. The multi-layered container as claimed in claim 2, wherein the length (L) of the removable wall section is arranged in a direction of an envelope line (M).

6. The multi-layered container as claimed in claim 2, wherein an axis of symmetry of the removable wall section in the peripheral direction (U) of the container forms a point of intersection with the edge of the wall section, said edge adjoining the access section, wherein the point of intersection with respect to the axis of symmetry of the access section is variable depending on the angle $\alpha$.

7. The multi-layered container of claim 1 wherein the removable wall section is rigid.

8. The multi-layered container of claim 1 wherein at least the outer wall is formed of paper, cardboard or plastic.

9. The multi-layered container of claim 1 wherein a size, shape and position of the removable wall section is determined by a predetermined breaking line.

10. The multi-layered container of claim 1 wherein the information comprises an imprint.

11. The multi-layered container of claim 1 wherein the container is a beverage container.

* * * * *